US009115576B2

(12) United States Patent
Dittmer

(10) Patent No.: US 9,115,576 B2
(45) Date of Patent: Aug. 25, 2015

(54) METHOD FOR PRODUCING HYDROCARBON RESOURCES WITH RF AND CONDUCTIVE HEATING AND RELATED APPARATUSES

(71) Applicant: HARRIS CORPORATION, Melbourne, FL (US)

(72) Inventor: Tim W. Dittmer, Viera, FL (US)

(73) Assignee: HARRIS CORPORATION, Melbourne, FL (US)

( * ) Notice: Subject to any disclaimer, the term of this patent is extended or adjusted under 35 U.S.C. 154(b) by 259 days.

(21) Appl. No.: 13/676,449

(22) Filed: Nov. 14, 2012

(65) Prior Publication Data

US 2014/0131032 A1 May 15, 2014

(51) Int. Cl.
*E21B 43/24* (2006.01)
*E21B 36/04* (2006.01)

(52) U.S. Cl.
CPC ..... *E21B 43/2401* (2013.01)

(58) Field of Classification Search
CPC ..... E21B 36/04; E21B 43/2401
USPC ..... 166/248, 302
See application file for complete search history.

(56) References Cited

U.S. PATENT DOCUMENTS

| | | | | |
|---|---|---|---|---|
| 2,350,429 | A | 6/1944 | Troupe | |
| 2,781,851 | A | 2/1957 | Smith | |
| 3,170,519 | A * | 2/1965 | Haagensen | 166/60 |
| 4,135,579 | A * | 1/1979 | Rowland et al. | 166/248 |
| 4,193,451 | A * | 3/1980 | Dauphine | 166/248 |
| 4,524,827 | A | 6/1985 | Bridges et al. | |
| 4,583,589 | A | 4/1986 | Kasevich | |
| 5,065,819 | A | 11/1991 | Kasevich | |
| 5,152,341 | A | 10/1992 | Kasevich | |
| 5,189,434 | A | 2/1993 | Bell | |
| 5,484,985 | A | 1/1996 | Edelstein et al. | |
| 5,586,213 | A * | 12/1996 | Bridges et al. | 392/312 |
| 6,009,318 | A | 12/1999 | Freed | |
| 6,565,127 | B2 | 5/2003 | Webb et al. | |
| 6,636,414 | B2 | 10/2003 | Obert et al. | |
| 6,870,439 | B2 | 3/2005 | Brown et al. | |
| 6,894,583 | B2 | 5/2005 | Brown et al. | |
| 6,930,568 | B2 | 8/2005 | Snyder et al. | |

(Continued)

FOREIGN PATENT DOCUMENTS

| | | |
|---|---|---|
| CA | 1001550 A1 | 12/1976 |
| WO | 2012037230 | 3/2012 |

OTHER PUBLICATIONS

Bridges et al., "In Situ RF Heating for Oil Sand and Heavy-Oil Deposits," IIT Research Institute, Chicago, Illinois, May 1985, pp. 1-11 (13 total pages).

(Continued)

*Primary Examiner* — Kenneth L Thompson
(74) *Attorney, Agent, or Firm* — Allen, Dyer, Doppelt, Milbrath & Gilchrist, P.A.

(57) ABSTRACT

A method is for producing hydrocarbon resources in a subterranean formation having therein an injector well and a producer well adjacent the injector well. The method may include conductively heating the subterranean formation by causing a current flow between the injector and producer wells, RF heating the subterranean formation after conductive heating by supplying RF power from at least the injector well, and producing the hydrocarbon resources from the producer well.

32 Claims, 5 Drawing Sheets

(56) References Cited

U.S. PATENT DOCUMENTS

| | | | | |
|---|---|---|---|---|
| 7,055,599 | B2 | 6/2006 | Kasevich | |
| 7,059,428 | B2 | 6/2006 | Frey et al. | |
| 7,239,286 | B1 | 7/2007 | Miller et al. | |
| 7,331,385 | B2 * | 2/2008 | Symington et al. | 166/248 |
| 7,398,823 | B2 * | 7/2008 | Montgomery et al. | 166/272.1 |
| 7,441,597 | B2 | 10/2008 | Kasevich | |
| 7,453,328 | B2 | 11/2008 | Jue | |
| 7,639,199 | B2 | 12/2009 | Rofougaran | |
| 7,646,267 | B1 | 1/2010 | Tsironis | |
| 7,891,421 | B2 | 2/2011 | Kasevich | |
| 7,893,888 | B2 | 2/2011 | Rofougaran | |
| 7,979,043 | B2 | 7/2011 | Rofougaran | |
| 8,646,524 | B2 * | 2/2014 | Al-Buraik | 166/248 |
| 8,863,839 | B2 * | 10/2014 | Kaminsky et al. | 166/302 |
| 2002/0023751 | A1 | 2/2002 | Neuroth et al. | |
| 2005/0199386 | A1 | 9/2005 | Kinzer | |
| 2009/0071652 | A1 | 3/2009 | Vinegar | |
| 2009/0139716 | A1 * | 6/2009 | Brock et al. | 166/272.1 |
| 2010/0078163 | A1 | 4/2010 | Banerjee et al. | |
| 2010/0294488 | A1 | 11/2010 | Wheeler et al. | |
| 2010/0294489 | A1 | 11/2010 | Dreher, Jr. et al. | |
| 2011/0120708 | A1 | 5/2011 | Dong et al. | |
| 2011/0309988 | A1 | 12/2011 | Parsche | |
| 2012/0067572 | A1 | 3/2012 | Trautman et al. | |
| 2012/0118565 | A1 * | 5/2012 | Trautman et al. | 166/272.6 |
| 2014/0014324 | A1 * | 1/2014 | Wright et al. | 166/248 |
| 2014/0110395 | A1 | 4/2014 | Parsche | |
| 2014/0216714 | A1 | 8/2014 | Dittmer et al. | |
| 2014/0216724 | A1 | 8/2014 | Dittmer et al. | |
| 2014/0216725 | A1 | 8/2014 | Dittmer et al. | |
| 2014/0216726 | A1 | 8/2014 | Dittmer et al. | |

OTHER PUBLICATIONS da Mata et al., "An Overview of the RF Heating Process in the Petroleum Industry," Department of Electrical Engineering—Federal University of Rio Grande do Norte, Brazil, SBMO/IEEE MTT-S IMOC '97 Proceedings, 1997, pp. 28-33.

Farr et al., "Design Considerations for Ultra-Wideband, High-Voltage Baluns," Farr Research, Albuquerque, New Mexico, PL-TR-97-1144, pp. 1-24 (32 total pages).

* cited by examiner

METHOD FOR PRODUCING HYDROCARBON RESOURCES WITH RF AND CONDUCTIVE HEATING AND RELATED APPARATUSES

FIELD OF THE INVENTION

The present invention relates to the field of hydrocarbon resource processing, and, more particularly, to hydrocarbon resource processing with subterranean heating and related methods.

BACKGROUND OF THE INVENTION

Energy consumption worldwide is generally increasing, and conventional hydrocarbon resources are being consumed. In an attempt to meet demand, the exploitation of unconventional resources may be desired. For example, highly viscous hydrocarbon resources, such as heavy oils, may be trapped in sands where their viscous nature does not permit conventional oil well production. This category of hydrocarbon resource is generally referred to as oil sands. Estimates are that trillions of barrels of oil reserves may be found in such oil sand formations.

In some instances, these oil sand deposits are currently extracted via open-pit mining. Another approach for in situ extraction for deeper deposits is known as Steam-Assisted Gravity Drainage (SAGD). The heavy oil is immobile at reservoir temperatures, and therefore, the oil is typically heated to reduce its viscosity and mobilize the oil flow. In SAGD, pairs of injector and producer wells are formed to be laterally extending in the ground. Each pair of injector/producer wells includes a lower producer well and an upper injector well. The injector/production wells are typically located in the payzone of the subterranean formation between an underburden layer and an overburden layer.

The upper injector well is used to typically inject steam, and the lower producer well collects the heated crude oil or bitumen that flows out of the formation, along with any water from the condensation of injected steam. The injected steam forms a steam chamber that expands vertically and horizontally in the formation. The heat from the steam reduces the viscosity of the heavy crude oil or bitumen, which allows it to flow down into the lower producer well where it is collected and recovered. The steam and gases rise due to their lower density. Gases, such as methane, carbon dioxide, and hydrogen sulfide, for example, may tend to rise in the steam chamber and fill the void space left by the oil defining an insulating layer above the steam. Oil and water flow is by gravity driven drainage urged into the lower producer well.

Operating the injection and production wells at approximately reservoir pressure may address the instability problems that adversely affect high-pressure steam processes. SAGD may produce a smooth, even production that can be as high as 70% to 80% of the original oil in place (OOIP) in suitable reservoirs. The SAGD process may be relatively sensitive to shale streaks and other vertical barriers since, as the rock is heated, differential thermal expansion causes fractures in it, allowing steam and fluids to flow through. SAGD may be twice as efficient as the older cyclic steam stimulation (CSS) process.

Many countries in the world have large deposits of oil sands, including the United States, Russia, and various countries in the Middle East. Oil sands may represent as much as two-thirds of the world's total petroleum resource, with at least 1.7 trillion barrels in the Canadian Athabasca Oil Sands, for example. At the present time, only Canada has a largescale commercial oil sands industry, though a small amount of oil from oil sands is also produced in Venezuela. Because of increasing oil sands production, Canada has become the largest single supplier of oil and products to the United States. Oil sands now are the source of almost half of Canada's oil production, while Venezuelan production has been declining in recent years. Oil is not yet produced from oil sands on a significant level in other countries.

U.S. Published Patent Application No. 2010/0078163 to Banerjee et al. discloses a hydrocarbon recovery process whereby three wells are provided: an uppermost well used to inject water, a middle well used to introduce microwaves into the reservoir, and a lowermost well for production. A microwave generator generates microwaves, which are directed into a zone above the middle well through a series of waveguides. The frequency of the microwaves is at a frequency substantially equivalent to the resonant frequency of the water so that the water is heated.

Along these lines, U.S. Published Patent Application No. 2010/0294489 to Dreher, Jr. et al. discloses using microwaves to provide heating. An activator is injected below the surface and is heated by the microwaves, and the activator then heats the heavy oil in the production well. U.S. Published Patent Application No. 2010/0294488 to Wheeler et al. discloses a similar approach.

U.S. Pat. No. 7,441,597 to Kasevich discloses using a radio frequency generator to apply radio frequency (RF) energy to a horizontal portion of an RF well positioned above a horizontal portion of an oil/gas producing well. The viscosity of the oil is reduced as a result of the RF energy, which causes the oil to drain due to gravity. The oil is recovered through the oil/gas producing well.

U.S. Pat. No. 7,891,421, also to Kasevich, discloses a choke assembly coupled to an outer conductor of a coaxial cable in a horizontal portion of a well. The inner conductor of the coaxial cable is coupled to a contact ring. An insulator is between the choke assembly and the contact ring. The coaxial cable is coupled to an RF source to apply RF energy to the horizontal portion of the well.

Unfortunately, long production times, for example, due to a failed start-up, to extract oil using SAGD may lead to significant heat loss to the adjacent soil, excessive consumption of steam, and a high cost for recovery. Significant water resources are also typically used to recover oil using SAGD, which impacts the environment. Limited water resources may also limit oil recovery. SAGD is also not an available process in permafrost regions, for example, or in areas that may lack sufficient cap rock, are considered "thin" payzones, or payzones that have interstitial layers of shale. While RF heating may address some of these shortcomings, further improvements to RF heating may be desirable. For example, it may be relatively difficult to install or integrate RF heating equipment into existing wells.

SUMMARY OF THE INVENTION

In view of the foregoing background, it is therefore an object of the present invention to provide a method for producing hydrocarbon resources that is efficient and robust.

This and other objects, features, and advantages in accordance with the present invention are provided by a method for producing hydrocarbon resources in a subterranean formation having therein an injector well and a producer well adjacent the injector well. The method includes conductively (e.g. causing a current flow below a predetermined frequency) heating the subterranean formation by causing a current flow between the injector and producer wells, RF heating the subterranean formation after conductive heating by supplying RF power from at least the injector well, and producing the hydrocarbon resources from the producer well. Advantageously, the initial hydraulic start-up time of the subterranean formation may be reduced.

In particular, the method may further comprise continuing conductive heating until respective regions of the subterranean formation surrounding the injector and producer wells are desiccated. The method may also further comprise continuing conductive heating until a region of the subterranean formation between the injector and producer wells is desiccated.

Another aspect is directed to a method for producing hydrocarbon resources in a subterranean formation having a well therein, the well comprising a plurality of galvanically isolated antenna elements. The method comprises conductively heating the subterranean formation by causing a current flow between the galvanically isolated antenna elements in the well, RF heating the subterranean formation after conductive heating by supplying RF power to the well, and producing the hydrocarbon resources from the subterranean formation.

Another aspect is directed to an apparatus for producing hydrocarbon resources in a subterranean formation. The apparatus comprises an injector well in the subterranean formation, a producer well adjacent the injector well, and a conductive current source configured to conductively heat the subterranean formation by causing a current flow between the injector and producer wells. The apparatus also includes an RF source configured to heat the subterranean formation after conductive heating by supplying RF power to at least the injector well. The producer well is configured to produce the hydrocarbon resources therefrom.

DETAILED DESCRIPTION OF THE PREFERRED EMBODIMENTS

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout, and prime notation is used to indicate similar elements in alternative embodiments.

Figure 1:
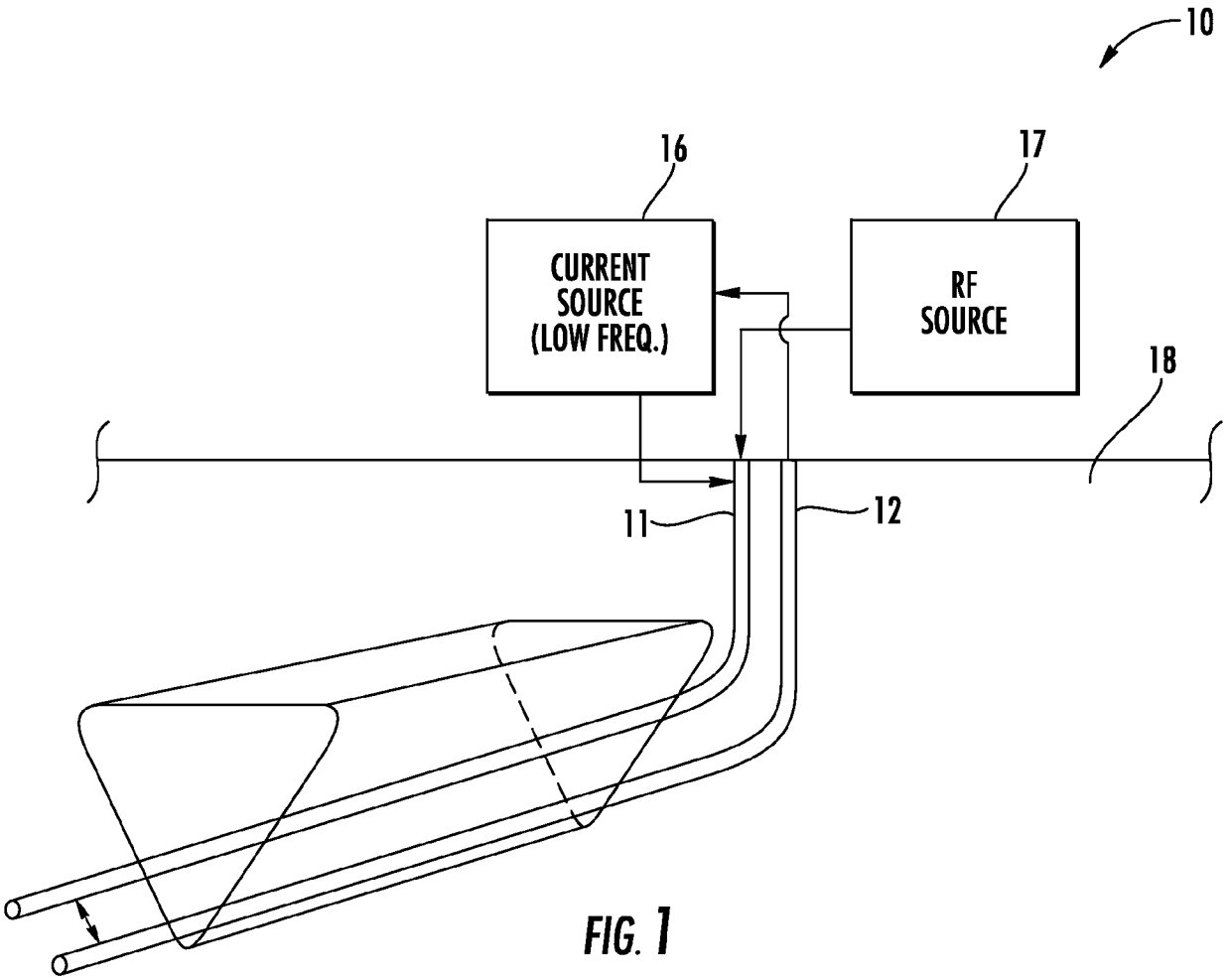
FIG. 1 is a schematic diagram of an apparatus for producing hydrocarbon resources, according to the present invention.
Figure 2:
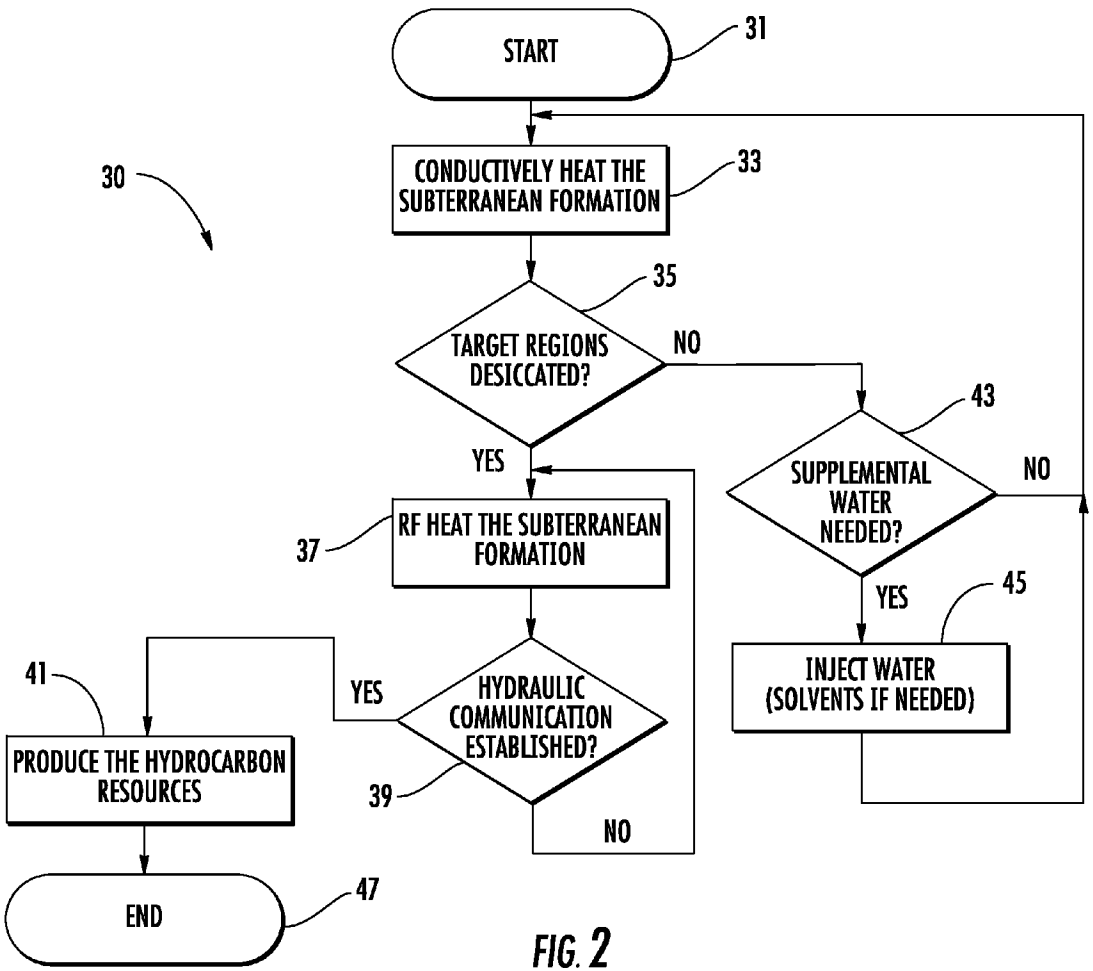
FIG. 2 is a flowchart illustrating a method for producing hydrocarbon resources in a subterranean formation, according to the present invention.

Referring initially to FIGS. 1-2, an apparatus 10 for producing hydrocarbon resources in a subterranean formation 18, and a method (flowchart 30, Block 31) for producing hydrocarbon resources according to the present invention are now described. The apparatus 10 includes an injector well 11 in the subterranean formation 18, a producer well 12 below the injector well, a conductive current source 16 coupled to the injector and producer wells, and an RF source 17 also coupled to the injection well.

The method for producing hydrocarbon resources includes using the current source 16 to conductively heat the subterranean formation by causing a current flow between the injector and producer wells 11-12 (Block 33). More specifically, the current source 16 causes a current flow that is below a predetermined frequency, for example, 50 or 60 Hz, by applying differential electrical power to each well 11-12. The lowered frequency of the applied current is advantageous since surface-to-payzone transmission line electrical length becomes insignificant, thus preserving the desired inverse phase relationship of the voltage on each horizontal electrode, with minimal subsurface complexity. In one embodiment, the current source 16 may comprise a direct current (DC) source, thereby using DC current to conductively heat the subterranean formation 18.

Additionally, the low frequency may reduce transmission line losses. The readily available AC power grid plus appropriate transformers may also be a convenient and inexpensive choice for the current source 16. In some embodiments, the injector and producer wells 11-12 may comprise highly conductive materials, such as aluminum and copper, or they may comprise inner/outer plating of such materials for further reducing transmission losses. Additionally, the high-pressure welded joints of the injector and producer wells 11-12 may also comprise highly conductive materials.

The method includes continuing the conductive heating until certain target regions in the subterranean formation 18 are desiccated, i.e. moisture levels are reduced to a certain threshold (Block 35). In particular, the method includes continuing the conductive heating until respective regions of the subterranean formation 18 surrounding the injector and producer wells 11-12 are desiccated, and/or a region of the subterranean formation between the injector and producer wells is desiccated (i.e. the plane between the injector and producer wells). Once the appropriate regions are desiccated, the injector and producer wells 11-12 are effectively isolated electrically.

Figure 3:
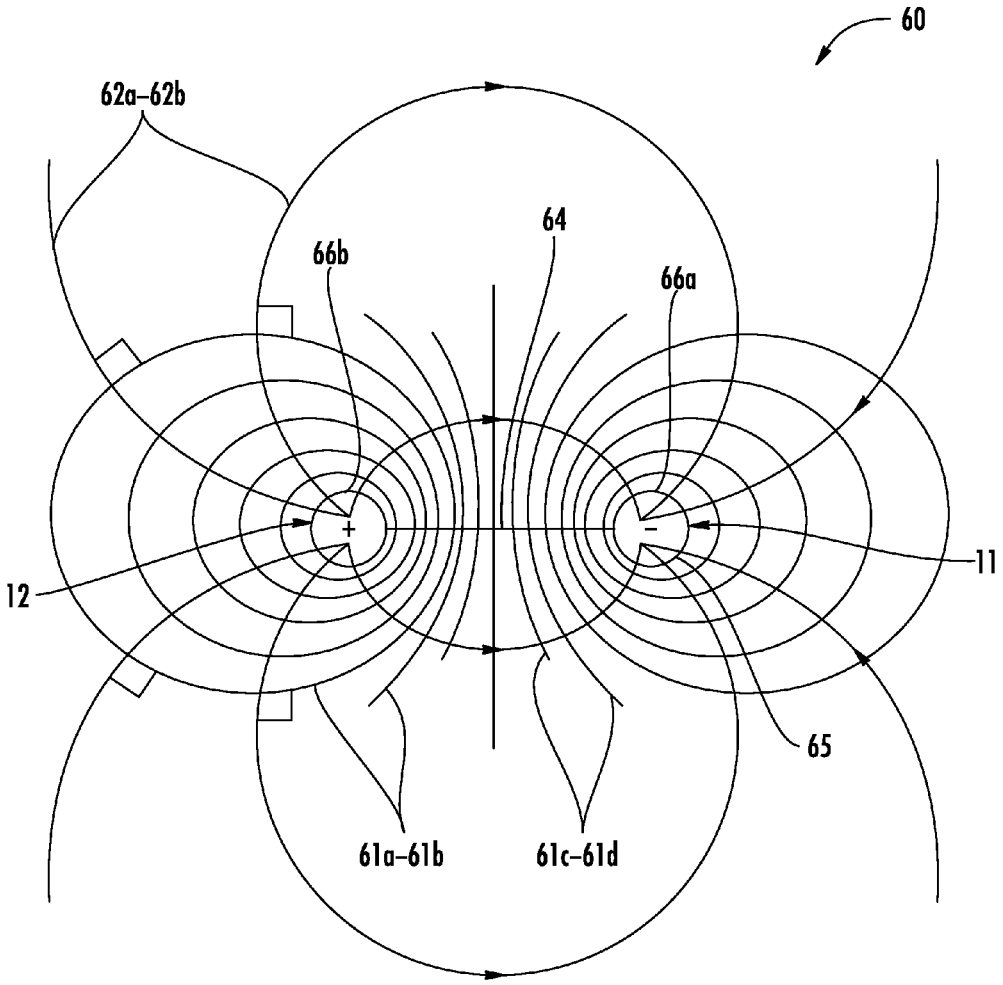
FIG. 3 is a cross-sectional electric field pattern for an embodiment of the apparatus of FIG. 1.

Referring briefly and additionally to FIG. 3, the electric field pattern 60 (field lines 62*a*-62*b*, equipotential lines 61*a*-61*d*) of the injector and producer wells 11-12 is shown. Indeed, since the inner surface 65 of the injector well 11 has the highest electric fields, this area desiccates first during the conductive heating step. As the conductive heating continues, the desiccation should proceed along a plane 64 and towards the producer well 12. The desiccation proceeds to the outer surfaces 66*a*-66*b* of the injector and producer wells 11-12. This may be highly desirable, as it will rapidly establish communication between injector and producer wells 11-12, allowing solvent injection and rapid initiation of bitumen flow. The conductive heating will terminate when the region immediately surrounding the producer well 12 desiccates.

In some embodiments, the current and RF sources 16-17 include impedance detectors for monitoring the desiccation levels in the subterranean formation 18. Since effective conductive heating requires a threshold amount of moisture in the subterranean formation 18, if it is detected that conduction current has diminished prior to desired hydraulic well communication, the method includes the injection of electrolytes, such as water, via at least one of the injector and producer wells to extend a timeframe of the conductive heating (Blocks 35, 43, 45).

The targeted desiccation is intended to create an environment conducive to RF heating between the injector and producer wells 11-12, i.e. isolating the electrodes (wells 11-12) by evaporating the water at the plane 64 and then surrounding the electrodes. In one embodiment, the targeted desiccation is detected when the current flow between the injector and producer wells 11-12 stops. Once the targeted regions are desiccated, the method includes disabling the current source 16 and engaging the RF source 17 for RF heating the subterranean formation 18 after conductive heating by supplying RF power from the injector well 11 (in some embodiments, the producer well also 12) (Block 37). The method includes using the RF source 17 to apply the RF heating to enhance hydraulic communication between the injector and producer wells 11-12, which may occur as soon as immediately after the beginning of the RF heating (RF heating is used to continue the flow of hydrocarbons). Once the initiation of the hydraulic communication between the injector and producer wells 11-12 is established, the method includes producing the hydrocarbon resources from the producer well 12 (Blocks 39, 41, 47). As needed, the method may further comprise injecting a fluid (e.g. at least one of steam, water, solvent, and gas) via the injector well 11 while producing the hydrocarbon resources from the producer well 12. Effective Solvent Extraction Incorporating Electromagnetic Heating (ES-EIEH) methods, as described in U.S. patent application Ser. No. 12/948,671, the contents of which are hereby incorporated by reference in their entirety, may also be applied.

Advantageously, the initial hydraulic start-up time of the subterranean formation 18 may be reduced. In typical well pair formations, the initial start-up time for the well pair may be several months long, which adds appreciably to the cost of hydrocarbon production. The method described herein provides coordinated application of conductive and RF heating, which reduces the start-up time.

Figure 4:
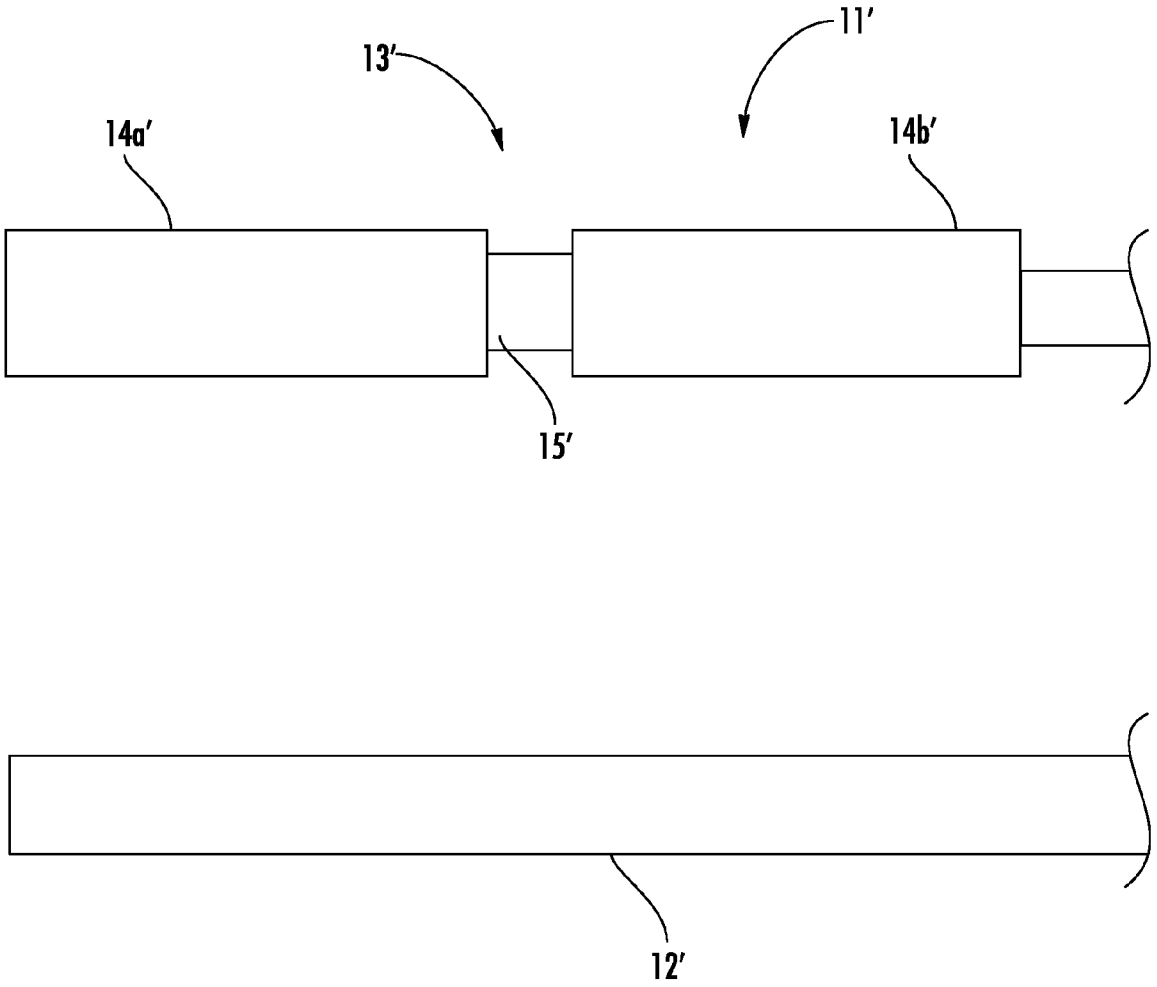
FIG. 4 is a schematic diagram of another embodiment of the injector and producer wells from the apparatus of FIG. 1.

Referring now to FIG. 4, another embodiment of the apparatus 10 for producing hydrocarbon resources in a subterranean formation 18 for is now described. In this embodiment of the apparatus 10', those elements already discussed above with respect to FIG. 1 are given prime notation and most require no further discussion herein. This embodiment differs from the previous embodiment in that the injector well 11' illustratively includes an antenna element 13'. The antenna element 13' comprises a plurality of galvanically isolated antenna elements (illustratively shown as a pair) 14*a*'-14*b*', and an isolation coupler 15' therebetween. In this embodiment, rather than driving the conductive heating current between the injector and producer wells 11'-12', the conductive current is driven between the pair of dipole antenna elements 14*a*'-14*b*'. This embodiment may not be as effective at creating hydraulic well communication as the prior embodiments, but it is simpler to implement and provides targeted desiccation around the antenna alone, should that prove beneficial in the course of hydrocarbon extraction.

In some embodiments, the apparatus 10' may include no separate producer well. In other words, the injector well 11' may be used to also retrieve the heated hydrocarbon resources from the subterranean formation 18, i.e. an infill well embodiment.

Figure 5:
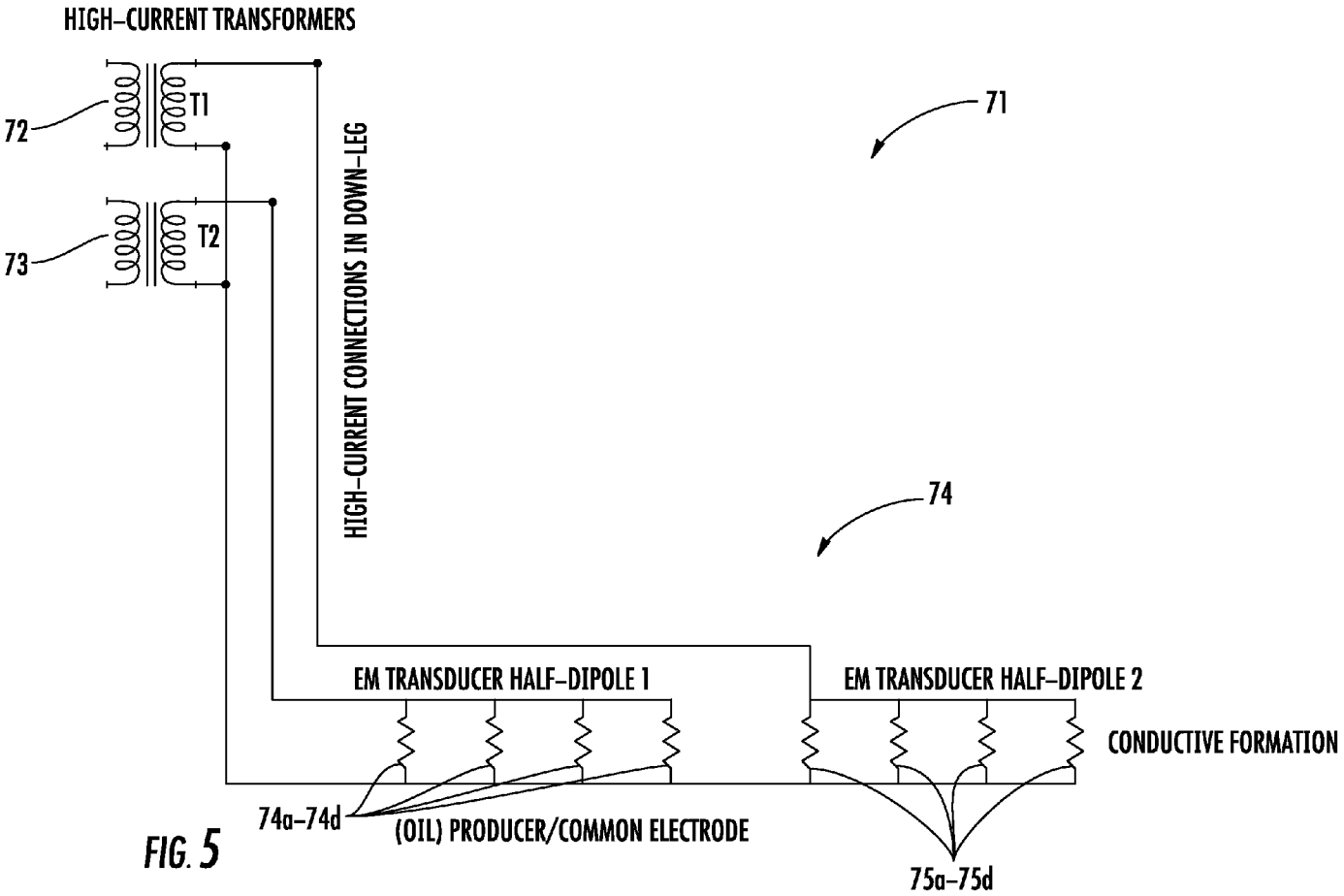
FIG. 5 is a schematic circuit diagram of an embodiment of the apparatus of FIG. 4.

Referring to FIG. 5, an exemplary implementation 71 is illustrated. This implementation illustratively includes a pair of high current transformers 72-73, and a dipole antenna 74 coupled thereto. The dipole antenna 74 is thus configured as two electrodes at approximately the same voltage, conducting current through the oilsands (shown as a plurality of resistors 74*a*-74*d* and 75*a*-75*d*.

In this embodiment, the method comprises conductively heating the subterranean formation 18' by causing a current flow between the injector and producer, and RF heating the subterranean formation after conductive heating by supplying RF power to the well, and producing the hydrocarbon resources from the subterranean formation.

Many modifications and other embodiments of the invention will come to the mind of one skilled in the art having the benefit of the teachings presented in the foregoing descriptions and the associated drawings. Therefore, it is understood that the invention is not to be limited to the specific embodiments disclosed, and that modifications and embodiments are intended to be included within the scope of the appended claims.

That which is claimed is:

1. A method for producing hydrocarbon resources in a subterranean formation having therein an injector well and a producer well adjacent thereto, the method comprising:

conductively heating the subterranean formation by causing a current flow between the injector and producer wells and using a conductive heating source operating at less than or equal to 60 Hz;

radio frequency (RF) heating the subterranean formation after conductive heating by supplying RF power from at least the injector well; and producing the hydrocarbon resources from the producer well.

2. The method of claim 1 further comprising continuing conductive heating until respective regions of the subterranean formation surrounding the injector and producer wells are desiccated.

3. The method of claim 1 further comprising continuing conductive heating until a region of the subterranean formation between the injector and producer wells is desiccated.

4. The method of claim 1 further comprising continuing RF heating to establish hydraulic communication between the injector and producer wells.

5. The method of claim 1 further comprising injecting water via at least one of the injector or producer wells to extend a timeframe of the conductive heating.

6. The method of claim 1 further comprising injecting at least one fluid via the injector well while producing the hydrocarbon resources from the producer well.

7. The method of claim 1 further comprising injecting at least one of steam, water, solvent, or gas via the injector well while producing the hydrocarbon resources from the producer well.

8. The method of claim 1 wherein conductive heating comprises causing a current flow below a predetermined frequency.

9. A method for producing hydrocarbon resources in a subterranean formation having a well therein, the well comprising an antenna with a plurality of galvanically isolated antenna elements, the method comprising:

conductively heating the subterranean formation by causing a current flow between the plurality of galvanically isolated antenna elements in the well and using a conductive heating source operating at less than or equal to 60 Hz;

radio frequency (RF) heating the subterranean formation after conductive heating by supplying RF power to the well; and producing the hydrocarbon resources from the subterranean formation.

10. The method of claim 9 further comprising continuing conductive heating until respective regions of the subterranean formation surrounding the antenna are desiccated.

11. The method of claim 9 further comprising continuing RF heating to establish hydraulic communication between the well and a producer well in the subterranean formation.

12. The method of claim 9 further comprising injecting water via the well to extend a timeframe of the conductive heating.

13. The method of claim 9 further comprising injecting at least one fluid via the well while producing hydrocarbon resources from a producer well in the subterranean formation.

14. The method of claim 9 further comprising injecting at least one of steam, water, solvent, or gas via the well while producing the hydrocarbon resources from a producer well in the subterranean formation.

15. The method of claim 9 wherein conductive heating comprises causing a current flow below a predetermined frequency.

16. An apparatus for producing hydrocarbon resources in a subterranean formation, the apparatus comprising:

an injector well disposed in the subterranean formation;

a producer well disposed spatially adjacent said injector well;

a conductive current source configured to conductively heat the subterranean formation by causing a current flow between said injector and producer wells, and operate at less than or equal to 60 Hz; and a radio frequency (RF) source configured to heat the subterranean formation after conductive heating by supplying RF power to at least said injector well;

said producer well configured to produce the hydrocarbon resources therefrom.

17. The apparatus of claim 16 wherein said conductive current source is configured to continue conductive heating until respective regions of the subterranean formation surrounding said injector and producer wells are desiccated.

18. The apparatus of claim 16 wherein said conductive current source is configured to continue conductive heating until a region of the subterranean formation between said injector and producer wells is desiccated.

19. The apparatus of claim 16 wherein said RF source is configured to continue RF heating to establish hydraulic communication between said injector and producer wells.

20. An apparatus for producing hydrocarbon resources in a subterranean formation, the apparatus comprising:

an injector well disposed in the subterranean formation and comprising a plurality of galvanically isolated antenna elements;

a producer well disposed spatially adjacent said injector well;

a conductive current source configured to conductively heat the subterranean formation by causing a current flow between said plurality of galvanically isolated antenna elements and operate at less than or equal to 60 Hz; and a radio frequency (RF) source configured to heat the subterranean formation after conductive heating by supplying RF power to said plurality of galvanically isolated antenna elements;

said producer well configured to produce the hydrocarbon resources therefrom.

21. The apparatus of claim 20 wherein said conductive current source is configured to continue conductive heating until a respective region of the subterranean formation surrounding said injector well is desiccated.

22. The apparatus of claim 20 wherein said RF source is configured to continue RF heating to establish hydraulic communication between said injector and producer wells.

23. A method for producing hydrocarbon resources in a subterranean formation having therein an injector well, the method comprising:

conductively heating the subterranean formation by causing a current flow between galvanically isolated elements in the injector well and using a conductive heating source operating at less than or equal to 60 Hz;

radio frequency (RF) heating the subterranean formation after conductive heating by supplying RF power from the injector well; and producing the hydrocarbon resources from the injector well based upon a cyclic basis.

24. The method of claim 23 further comprising continuing conductive heating until respective regions of the subterranean formation surrounding the injector are desiccated.

25. The method of claim 23 further comprising continuing RF heating to improve heat field continuation and uniformity from the injector well.

26. The method of claim 23 further comprising injecting water via the injector well to extend a timeframe of the conductive heating.

27. The method of claim 23 further comprising injecting at least one fluid via the injector well.

28. The method of claim 23 further comprising injecting at least one of steam, water, solvent, or gas via the injector well.

29. The method of claim 23 wherein conductive heating comprises causing a current flow below a predetermined frequency.

30. An apparatus for producing hydrocarbon resources in a subterranean formation, the apparatus comprising:

an injector well disposed in the subterranean formation and comprising a plurality of galvanically isolated antenna elements;

a conductive current source configured to conductively heat the subterranean formation by causing a current flow between said plurality of galvanically isolated antenna elements, and operate at less than or equal to 60 Hz; and a radio frequency (RF) source configured to heat the subterranean formation after conductive heating by supplying RF power to said plurality of galvanically isolated antenna elements;

said injector well configured to produce the hydrocarbon resources therefrom.

31. The apparatus of claim 30 wherein said conductive current source is configured to continue conductive heating until a respective region of the subterranean formation surrounding said injector well is desiccated.

32. The apparatus of claim 30 wherein said RF source is configured to continue RF heating to establish hydraulic communication with said injector well.

* * * * *